United States Patent [19]

Payne

[11] Patent Number: 4,590,670

[45] Date of Patent: May 27, 1986

[54] METHOD OF MAKING AN ELECTRICAL SWITCH

[75] Inventor: Frank Payne, Knoxville, Tenn.

[73] Assignee: Robertshaw Controls Company, Richmond, Va.

[21] Appl. No.: 635,216

[22] Filed: Jul. 27, 1984 (Under 37 CFR 1.47)

Related U.S. Application Data

[62] Division of Ser. No. 545,518, Oct. 26, 1983, Pat. No. 4,479,039.

[51] Int. Cl.[4] ..... H01H 11/04

[52] U.S. Cl. ..... 29/622

[58] Field of Search ..... 29/622; 200/67 D, 67 DA, 200/72 A, 83 P; 337/309, 310, 311

[56] References Cited

U.S. PATENT DOCUMENTS

| | | | |
|---|---|---|---|
| 2,381,835 | 8/1945 | Moorhead | 200/67 DA |
| 2,598,856 | 6/1952 | Swan et al. | 200/67 D |
| 4,243,858 | 1/1981 | Place | 200/83 P |
| 4,314,122 | 2/1982 | Bawer et al. | 200/72 A |
| 4,351,105 | 9/1982 | Poling | 29/622 |

FOREIGN PATENT DOCUMENTS

| | | | |
|---|---|---|---|
| 1479025 | 4/1967 | France | 200/67 D |

*Primary Examiner*—Howard N. Goldberg
*Assistant Examiner*—P. W. Echols
*Attorney, Agent, or Firm*—Candor, Candor & Tassone

[57] ABSTRACT

An electrical switch construction and method of making the same are provided, the construction comprising a housing, a pair of electrical switching units carried by the housing, and a condition responsive actuator carried by the housing and being operatively associated with the units to serially operate the units as the sensed condition respectively reaches two different predetermined conditions. The actuator comprises an axially movable plunger for operating one of the units and a snap disc for operating the other of the units when snapped overcenter, the actuator having a spring operatively associated with the plunger and the snap disc to move the snap disc overcenter when the plunger is moved to a certain axial position thereof by the actuator sensing one of the conditions. The actuator has a tubular member telescopically disposed on the plunger and operatively interconnecting the snap disc to the other unit when the snap disc is snapped overcenter.

14 Claims, 10 Drawing Figures

METHOD OF MAKING AN ELECTRICAL SWITCH

CROSS REFERENCE TO RELATED APPLICATION

This application is a divisional patent application of its copending parent patent application, Ser. No. 545,518, filed Oct. 26, 1983, now U.S. Pat. No. 4,479,039.

BACKGROUND OF THE INVENTION

1. Field of the Invention

This invention relates to an improved electrical switch construction having a pair of serially operated electrical switching units as well as to a method of making such a switch construction.

2. Prior Art Statement

It is known to applicant to provide an electrical switch construction comprising a housing means, a pair of electrical switching units carried by the housing means, and condition responsive actuator means carried by the housing means and being operatively associated with the units to serially operate the units as the sensed condition respectively reaches two different predetermined conditions. The actuator means comprises an axially movable plunger for operating one of the units and a snap disc for operating the other of the units when snapped overcenter, the actuator means having a spring means operatively associated with the plunger and the snap disc to move the snap disc overcenter when the plunger is moved to a certain axial position thereof by the actuator means sensing one of the conditions. The snap disc itself provides one of the electrical contacts for its respective switching unit.

SUMMARY OF THE INVENTION

It is one feature of this invention to provide an improved electrical switch construction having a pair of electrical switching units that are operated in a serial manner by a condition responsive actuator means sensing two different predetermined conditions.

In particular, it was found according to the teachings of this invention that when a snap disc is utilized to operate one of the switching units, the snap disc can be operatively interconnected to its switching unit by a tubular member that is telescoped on an axially movable plunger of the actuator means.

For example, one embodiment of this invention provides an electrical switch construction comprising a housing means, a pair of electrical switching units carried by the housing means, and condition responsive actuator means carried by the housing means and being operatively associated with the units to serially operate the units as the sensed condition respectively reaches two different predetermined conditions. The actuator means comprises an axially movable plunger for operating one of the units and a snap disc for operating the other of the units when snapped overcenter, the actuator means having spring means operatively associated with the plunger and the snap disc to move the snap disc overcenter when the plunger is moved to a certain axial position thereof by the actuator means sensing one of the sensed conditions. The actuator means has a tubular member telescopically disposed on the plunger and operatively interconnecting the snap disc to the other unit when the snap disc is snapped overcenter.

Accordingly, it is an object of this invention to provide an improved electrical switch construction having one or more of the novel features of this invention as set forth above or hereinafter shown or described.

Another object of this invention is to provide an improved method of making such an electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
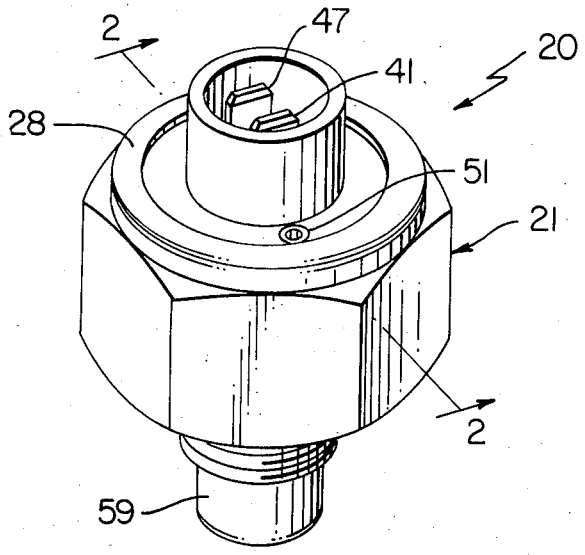
FIG. 1 is a top perspective view of one embodiment of the electrical switch construction of this invention.

While the various features of this invention are hereinafter described and illustrated as being particularly adapted to provide an electrical switch construction that is operated in response to sensed temperature or pressure, it is to be understood that the various features of this invention can be utilized singly or in any combination thereof to provide an electrical switch construction that can be operated by other conditions as desired.

Therefore, this invention is not to be limited to only the embodiments illustrated in the drawings, because the drawings are merely utilized to illustrate some of the wide variety of uses of this invention.

Referring now to FIGS. 1–5, an improved electrical switch construction of this invention is generally indicated by the reference numeral 20 and comprises a housing means 21 formed from a cup-shaped housing member 22 having a closed end 23 and an open end 24 and receiving therein a pair of housing members 25 and 26 disposed in stacked relation against the end wall 27 of the closed end 23 and being held therein by a turned over portion 28 of the open end 24 of the housing member 22, an annular sealing means 29 being utilized to seal the housing members 22, 25 and 26 together as illustrated.

While the housing parts 22, 25 and 26 can be formed of any suitable material, it is preferred that the housing parts 25 and 26 be formed of electrically insulating material, such as plastic material, while the housing part 22 is formed of metallic material.

A pair of electrical switching units that are respectively generally indicated by the reference numerals 30 and 31 are disposed in the housing means 21 and are carried thereby in a manner hereinafter set forth, the switching units 30 and 31 being adapted to be serially operated by a condition responsive actuator means that is generally indicated by the reference numeral 32 and that is also being carried by the housing means 21 in a manner hereinafter set forth.

The electrical switching unit 30 comprises a flexible electrically conductive switch blade 33 having an electrical contact means 34 on the free end 35 thereof, the switch blade 33 being carved from a medial portion of a circular metallic disc 36 that has its outer periphery 37 captured between cooperating surfaces 38 and 39 on the housing members 25 and 26 as illustrated whereby the other end 40 of the switch blade 33 is, in effect, cantilever mounted to the housing means 21 so that the switch blade 33 is adapted to be moved relative to the housing means 21 in a manner hereinafter set forth. The disc 36 and, thus, the switch blade 33 is electrically interconnected to a terminal 36' (see FIG. 5) carried by the housing means 21.

The housing member 26 carries an electrical terminal 41 that has an end 42 bent in the manner illustrated so as to provide a fixed contact means against which the contact means 34 of the switch blade 33 is adapted to be moved in the manner illustrated in FIG. 3 and as hereinafter set forth whereby the fixed contact means 42 forms part of the switching unit 30.

The fixed contact means 42 also provides part of the other switching unit 31 which comprises an electrically conductive metallic switch blade 43 having one end 44 cantilever mounted to the housing member 26 by a rivet means 45 that secures the end 44 of the switch blade 43 to an end 46 of a terminal 47 also carried by the housing member 26 as illustrated whereby the switch blade 43 is also electrically interconnected to the terminal 47.

Figure 2:
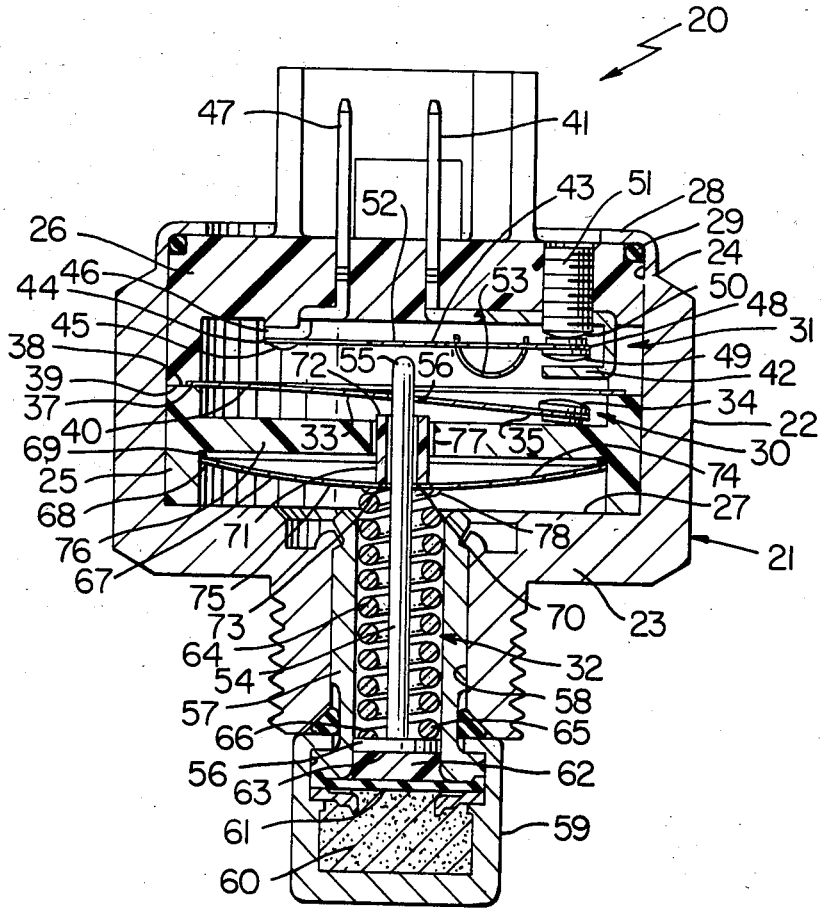
FIG. 2 is an enlarged cross-sectional view taken on line 2—2 of FIG. 1.
Figure 3:
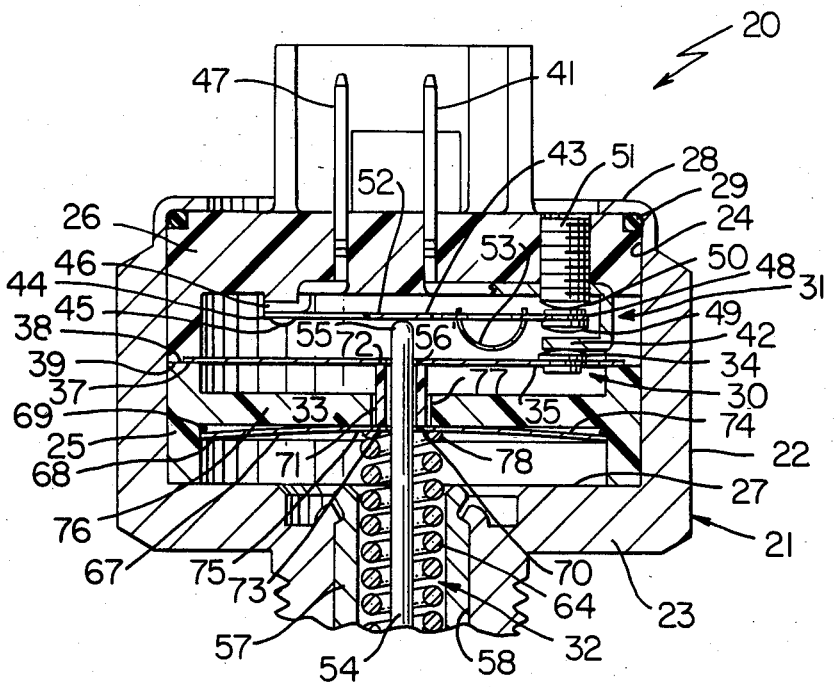
FIG. 3 is a fragmentary view similar to FIG. 2 and illustrates the actuator means of the switch construction in another operating condition thereof.

The other end 48 of the switch blade 43 carries an electrical contact means 49 adapted to be moved against the fixed contact means 42 in the manner illustrated in FIG. 4 and as hereinafter described, the switch blade 43 normally being disposed against an end 50 of an adjustable stop member 51 carried by the housing member 26 as illustrated in FIGS. 2 and 3.

Figure 4:
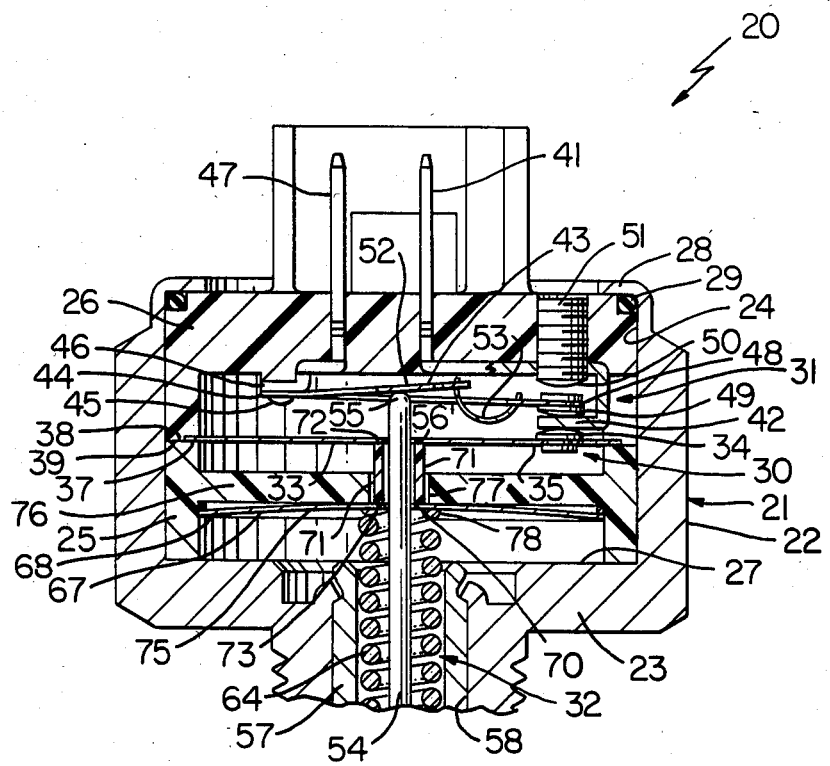
FIG. 4 is a view similar to FIG. 3 and illustrates the actuator means of the switch construction in another operating condition thereof.
Figure 5:
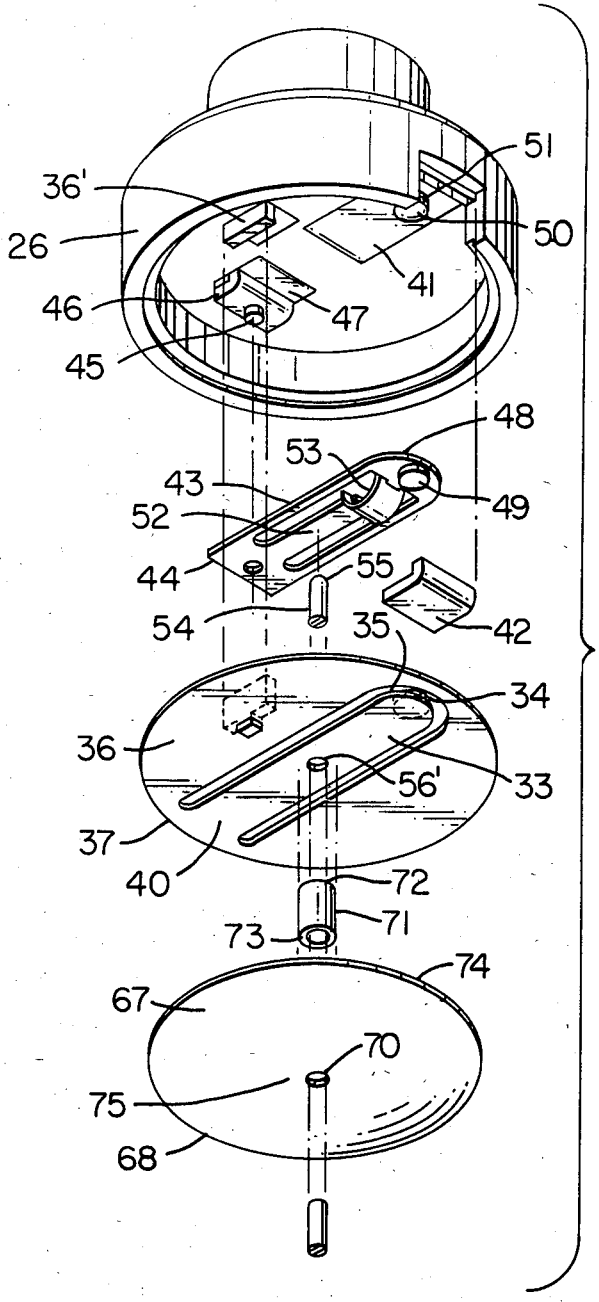
FIG. 5 is an exploded perspective view of certain parts of the switch construction illustrated in FIGS. 1–4.
Figure 6:
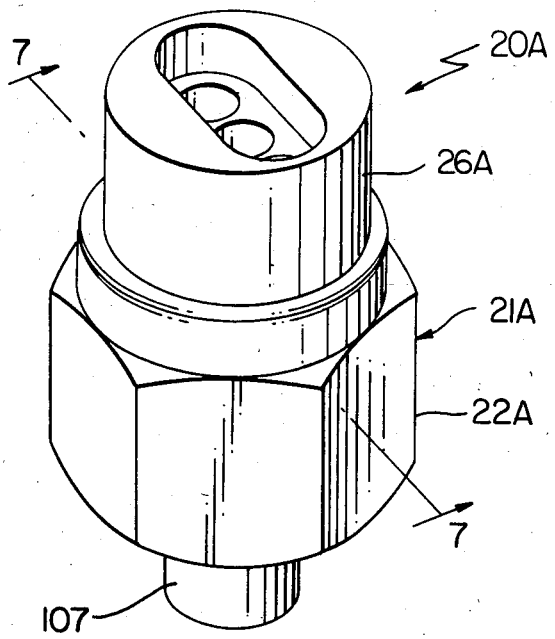
FIG. 6 is a view similar to FIG. 1 and illustrates another embodiment of the electrical switch construction of this invention.

The switch blade 43 is rendered snap acting by having an integral tongue 52 carved medially thereof and being provided with a rolling spring 53 in a manner well known in the switch art so that when the rolling spring 53 is moved overcenter by having the tongue 52 moved upwardly in the manner illustrated in FIG. 4, the rolling spring 53 snaps the end 48 of the blade 43 downwardly to place the contact means 49 against the fixed contact means 42. Conversely, when the tongue 43 is permitted to move downwardly back to the position illustrated in FIG. 3, the rolling spring 53 acts in a manner to snap the movable contact means 49 from the fixed contact means 42 against the end 50 of the stop 51 as illustrated in FIGS. 2 and 3 and in a manner well known in the art.

The actuator means 32 of the electrical switch construction 20 comprises an axially movable plunger 54 having an upper end 55 that projects through a suitable opening 56' in the switch blade 33 so as to be engageable against the tongue 52 of the snap-acting switch blade 43 to operate same in a manner hereinafter set forth. The plunger 54 has an enlarged disc-like end 56 disposed in a tubular member 57 secured in an opening 58 formed through the closed end 23 of the cup-shaped housing member 22 in the manner illustrated in FIG. 2 whereby the enlarged end 56 of the plunger 54 is adapted to be guided in its axial movement in the housing means 21 by the tubular member 57 for a purpose hereinafter set forth.

The tubular member 57 of the actuator means 32 is secured to a cup-shaped member 59 that contains a thermally responsive wax charge 60 therein which is adapted to act against a flexible diaphragm means 61 in a manner well known in the art to urge the diaphragm means 61 upwardly in FIG. 2 upon the sensing of increasing temperature conditions to progressively move the plunger 54 upwardly in FIG. 2 because the volume of the wax charge 60 increases as the sensed temperature thereof increases. Conversely, the wax charge 60 will contract in the member 59 upon the decreasing of the sensed temperature thereof to permit the plunger 54 to be moved axially downwardly within the tubular member 57. The diaphragm 61 actually acts on a resilient piston member 62 that is disposed between the diaphragm 61 and one side 63 of the end 56 of the plunger 54.

A coiled compression spring 64 is disposed in the tubular member 57 and has one end 65 thereof bearing against an annular surface or shoulder 66 of the end 56 of the plunger 54 to tend to maintain the end 56 against the piston member 62 and, thus, maintain the piston member 62 against the diaphragm 61 so that the plunger 54 will move in unison with the diaphragm 61 through the changes in the volume of the wax charge 60 within the member 59 in a manner well known in the art and as previously set forth.

The actuator means 32 includes a metallic snap disc 67 having its outer periphery 68 disposed against a pivot member 69 of the housing member 25 in a manner well known in the art, the snap disc 67 having an opening 70 passing centrally therethrough and through which the plunger 54 extends as illustrated in FIG. 2.

A tubular member 71 is telescopically disposed on the plunger 54 and has opposed ends 72 and 73, the end 73 of the tubular member 71 being engageable against the side 74 of the snap disc 67 while the other end 72 thereof is engageable with the switch blade 33 as will be apparent hereinafter.

The snap disc 67 has a normal bias to be in the bowed condition illustrated in FIG. 2 wherein the central portion 75 of the snap disc 67 is disposed spaced from a wall 76 of the housing member 25, the wall 76 having an opening 77 therethrough and through which the tubular member 71 and the plunger 54 are adapted to extend as illustrated in FIG. 2.

The compression spring 64 has its other end 78 bearing against the central portion 75 of the snap disc 67 and when the compression spring 64 is under sufficient compression by the end 56 of the plunger 54 being moved upwardly by the wax charge 60 in the member 59 in a manner hereinafter set forth, the force of the compression spring 64 is adapted to overcome the force of the snap disc 67 and cause the snap disc 67 to snap upwardly in the manner illustrated in FIG. 3 so that the central portion 75 thereof is disposed against the wall 76 and causes the tubular member 71 to have its end 72 engage against the switch blade 33 and move the switch blade 33 from its normal biased condition as illustrated in FIG. 2 wherein the contact means 34 is normally disposed against the wall 76 so as to place the contact means 34 of the switch blade 33 into electrical contact with the fixed contact means 42 in the manner illustrated in FIGS. 3 and 4 as long as the compression spring 64 is under at least a certain compressed condition thereof. However, when the compression spring 64 is permitted to expand by having the end 56 of the plunger 54 move downwardly as the wax charge 60 in the member 59 contracts upon sensing a decrease of temperature, the natural bias of the snap disc 67 is to snap downwardly from the position illustrated in FIG. 4 back to the position illustrated in FIG. 2 and thereby move the tubular member 71 away from the switch blade 33 and permit the natural bias of the switch blade 33 to move the contact means 34 out of contact with the fixed contact means 42 and place the contact means 34 against the wall 76 in the manner illustrated in FIG. 2.

From the above, it can be seen that the electrical switch construction 20 of this invention can be made from the parts previously described by the method of this invention previously described to operate in a manner now to be described.

After the switch construction 20 has been made in the manner previously described with the wax charge 60 having been so selected, the wax charge 60 will expand in such a manner upon an increase in temperature thereof that when a first sensed temperature condition thereof exists, the wax charge 60 will cause the snap disc 67 to snap overcenter from the condition illustrated in FIG. 2 to the position illustrated in FIG. 3 to operate the switch means 30 by placing the contact means 34 into electrical contact with the fixed contact means 42 whereby a desired electrical switching operation can take place through appropriate electrical circuit means (not shown) interconnected to the terminal means (not all shown) of the switch construction 20 in a manner well known in the art. Such wax charge 60 will also cause the other switch unit 31 to cause its switching operation by moving the switch blade 43 from the position illustrated in FIG. 3 to the position illustrated in FIG. 4 when another certain temperature condition is sensed by the wax charge 60 whereby the switch unit 31 will also provide an electrical switching operation in a manner similar to the switch unit 30 for any desired purpose.

In order to calibrate the wax charge 60 in the member 59 to produce the switching operation of the switch means 30 and 31 when the sensed temperature condition reaches the desired temperatures, the member 59 can be suitably dimpled to change the volume of the wax containing chamber in the member 59 in a manner well known in the art.

Conversely, as the temperature sensed by the condition responsive actuator means 32 falls below the temperature that caused the switch unit 31 to be switched, the plunger means 54 is moved downwardly from the position illustrated in FIG. 4 back to the position illustrated in FIG. 3 to cause the switch unit 31 to switch the switch blade 43 to the condition illustrated in FIG. 3 and thereby change the switching operation in the electrical circuit connected to the switching unit 31. Likewise, a further decrease in the sensed temperature by the wax charge 60 below the temperature that caused the snap disc 67 to be snapped from the condition illustrated in FIG. 2 to the position illustrated in FIG. 3 causes the snap disc 67 to snap downwardly to the position illustrated in FIG. 2 and thereby permit the switching unit 30 to change its switching operation from the condition illustrated in FIG. 3 to the condition illustrated in FIG. 2.

Therefore, it can be seen that the electrical switch construction 20 is a temperature responsive device that serially operates the two switching units 30 and 31 in relation to two different sensed temperature conditions of the actuator means 32 thereof.

For example, with the switch construction 20 in the condition illustrated in FIG. 2, the normal bias of the snap disc 67, switch blade 33 and switch blade 43 is to hold the same in the condition illustrated in FIG. 2 and as long as the temperature being sensed by the wax charge 60 is below a first certain predetermined temperature condition, the switch construction 20 will remain in the condition illustrated in FIG. 2 wherein the contact means 34 of the switching unit 30 is out of contact with the fixed contact means 42 and the contact means 49 of the switching unit 31 is also out of contact with the fixed contact means 42.

However, when the temperature sensed by the wax charge 60 reaches the first predetermined temperature condition thereof, the wax charge 60 has expanded in such a manner that the plunger 54 has been moved axially upwardly in FIG. 2 to compress the compression spring 64 in such a manner that the thus compressed compression spring 64 has a force sufficient to overcome the natural bias of the snap disc 67 to snap the same upwardly in the manner illustrated in FIG. 3 against the wall 76 so that the medial portion 75 of the snap disc 67 causes the tubular member 71 to move against the switch blade 33 and move the switch blade 33 so that its contact means 34 is placed against the fixed contact means 42 as illustrated in FIG. 3 with a snap action to thereby cause a switching operation of the switching unit 30. Should the temperature sensed by the wax charge 60 increase to the second predetermined temperature condition thereof, the wax charge 60 has expanded in the member 59 in such a manner that the same causes the plunger 54 to further move axially upwardly from the position illustrated in FIG. 3 to the position illustrated in FIG. 4 wherein the end 55 of the plunger 54 acts on the tongue 52 of the switch blade 43 to cause the snap-acting switch means 31 to snap the switch blade 43 in a manner to place the contact means 49 thereof against the fixed contact means 42 as illustrated in FIG. 4.

Conversely, as the temperature falls below the second predetermined temperature previously described, the wax charge 60 contracts in the member 59 a certain amount so that the compression spring 64 can move the plunger 54 downwardly a distance that permits the natural bias of the snap-acting switch unit 31 to cause the switch blade 43 to snap upwardly against the stop 51 as illustrated in FIG. 3 to change the switching operation of the switching unit 31. Subsequently, should the sensed temperature fall below the other predetermined temperature condition thereof, the wax charge 60 will have contracted sufficiently in the member 59 so that the force of the compression spring 64 will move the plunger 54 axially downwardly to a position where the reduced compressed force of the compression spring 64 can no longer hold the snap disc 67 in the upward bowed condition of FIG. 3 whereby the snap disc 67 will snap donwardly from the position illustrated in FIG. 3 to the position illustrated in FIG. 2 so that the end 73 of the tubular member 71 will move away from the switch blade 33 a distance that is at least sufficient to permit the switch blade 33 to move through its natural bias out of contact with the fixed contact means 42 as illustrated in FIG. 2.

In order to prevent any adverse electrical interconnection between the switch blades 33 and 43 by the plunger 54, the plunger 54 can be formed of electrically insulating material or can have an electrically insulating end cap sleeve (not shown) disposed over the end 55 thereof so that the thus insulated end 55 will not transmit any electrical current between the blades 43 and 33 when the insulated end 55 is disposed against the tongue 51 of the switch blade 43.

Another electrical switch construction of this invention is generally indicated by the reference numeral 20A in FIGS. 6–10 and parts thereof similar to the electrical switch construction 20 previously described are indicated by like reference numerals followed by the reference letter "A".

As illustrated in FIGS. 6–10, it can be seen that the electrical switch construction 20A is substantially identical to the switch construction 20 previously described except that a force spreader 100 is utilized to act between the end 78A of the spring 64A and the snap disc 67A and that the actuator means 32A is pressure operated and not temperature operated as provided in the electrical switch construction 20.

In particular, the force spreader 100 comprises a disc-like member 101 having a tubular portion 102 extending medially therefrom and through which an opening 103 is formed, the plunger 54A extending through the opening 103 of the force spreader 100 so as to extend through the opening 77A in the wall 76A as well as through the opening 56'A of the switch blade 33A in order to have its end 55A be adapted to operate the switch blade 43A of the switching unit 31A in the manner previously described.

The force spreader 101 has an annular ridge 104 for engaging against the snap disc 67A in a manner well known in the art of using force spreaders for operating snap discs and to provide for calibration purposes by selecting the desired force spreader.

Figure 7:
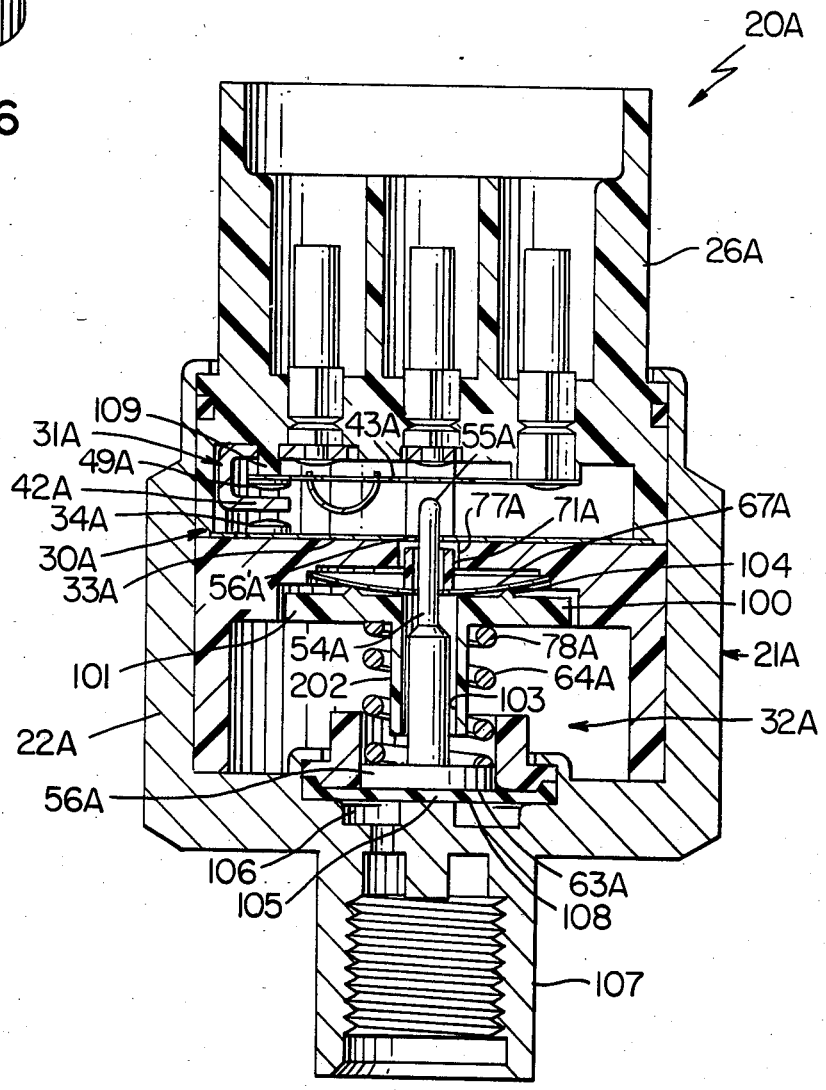
FIG. 7 is an enlarged cross-sectional view taken on line 7—7 of FIG. 6.

The actuator means 32A includes a flexible diaphragm 105 that is carried by the housing means 21A and is disposed against the surface 63A of the enlarged end 56A of the plunger 54A and is subjected to pressure within a chamber 106 formed in the housing member 22A and being adapted to be fed fluid pressure through internally threaded nipple portion 107 of the housing member 22A as illustrated in FIG. 7. For example, a suitable source of pressure can be coupled to the nipple portion 107 of the housing means 21A whereby the fluid pressure in the chamber 106 acting on the side 108 of the flexible diaphragm 105 will tend to move the plunger 54A upwardly in opposition to the force of the compression spring 64A.

Figure 8:
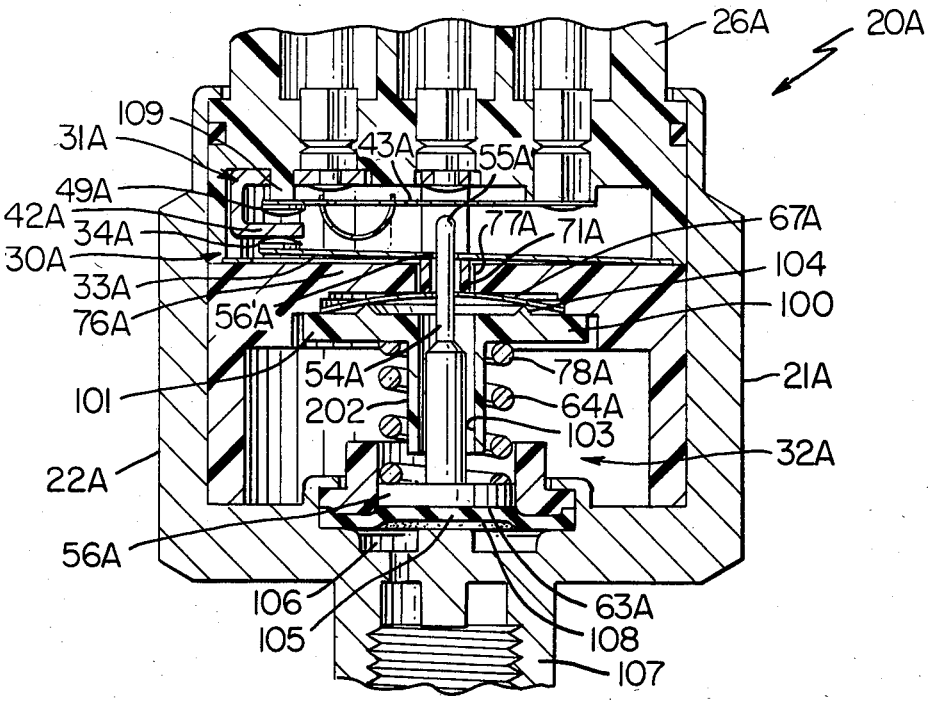
FIG. 8 is a fragmentary view similar to FIG. 7 and illustrates the actuator means of the switch construction in another operating condition thereof.

Thus, when the fluid pressure in the chamber 106 reaches a first predetermined pressure, the same has caused the flexible diaphragm 105 to move the plunger 54A upwardly a sufficient distance that the increased compressed force of the compression spring 64A causes the force spreader 101 to act on the snap disc 67A in a manner to snap the same overcenter as illustrated in FIG. 8 whereby the tubular member 71A causes the switch blade 33A to have its contact means 34A moved into contact with the fixed contact means 42A in the manner previously set forth.

Figure 9:
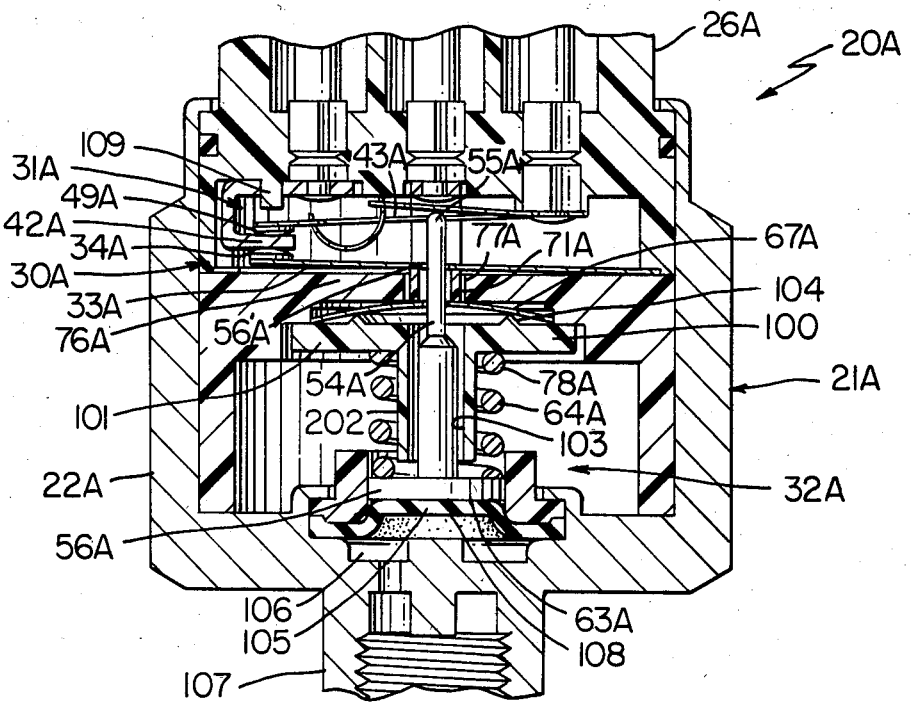
FIG. 9 is a view similar to FIG. 8 and illustrates the actuator means of the switch construction in another operating condition thereof.
Figure 10:
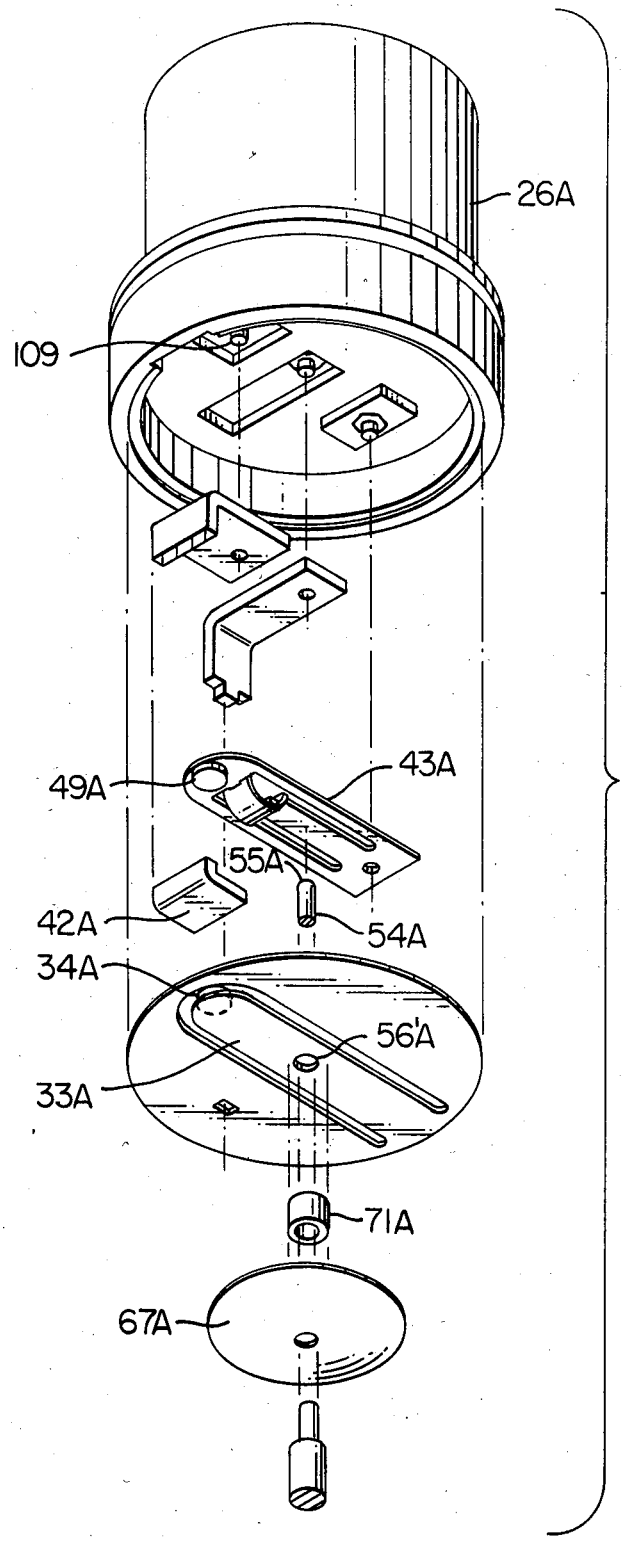
FIG. 10 is an exploded perspective view illustrating certain parts of the electrical switch construction of FIGS. 6–9.

Should the fluid pressure in the chamber 106 increase to the second predetermined value thereof, the fluid pressure is adapted to cause the plunger 54A to move upwardly in opposition to the force of the compression spring 64A in a manner that the end 55A of the plunger 54A causes the snap switch blade 43A to be snapped downwardly from the position illustrated in FIG. 8 to the position illustrated in FIG. 9 wherein the electrical contact means 49A thereof is placed into electrical contact with the fixed contact means 42A in the manner illustrated in FIG. 9, the contact means 49A moving away from a formed stop 109 on the housing member 26A rather than from an adjustable stop that is provided by the member 51 of the switch construction 20 previously described.

Thus, it can be seen that the switch construction 20A of this invention is substantially the same as the switch construction 20 previously described and operates in substantially the same manner except that the two conditions thereof that cause the switching means 30A and 31A to serially change their switching operations are two different predetermined pressure values rather than two different temperature values as provided for the electrical switch construction 20 previously described. Accordingly, it is believed unnecessary to further describe the method of making and the operation of the switch construction 20A as the same are substantially the same as previously described for the switch construction 20.

Therefore, it can be seen that this invention not only provides an improved electrical switch construction, but also this invention provides an improved method of making such an electrical switch construction.

While the forms and methods of this invention now preferred have been illustrated and described as required by the Patent Statute, it is to be understood that other forms and method steps can be utilized and still fall within the scope of the appended claims.

What is claimed is:

1. In a method of making an electrical switch construction comprising the steps of providing a housing means, disposing a pair of electrical switching units in said housing means, disposing a condition responsive actuator means in said housing means so as to be operatively associated with said units to serially operate said units as a condition being sensed by said condition responsive actuator means respectively reaches two different predetermined conditions, forming said actuator means to comprise an axially movable plunger for operating one of said units and a snap disc for operating the other of said units when snapped overcenter, and forming said actuator means to have a spring means operatively associated with said plunger and said snap disc to move said snap disc overcenter when said plunger is moved to a certain axial position thereof by said actuator means sensing one of said conditions, the improvement comprising the steps of forming said actuator means to have a tubular member, telescopically disposing said tubular member on said plunger so as to be disposed intermediate said snap disc and said other unit and normally be movable relative to said snap disc and said other unit, and forming said tubular member to be of a length so as to operatively interconnect said snap disc to said other unit with said tubular member when said snap disc is snapped overcenter.

2. A method of making an electrical switch construction as set forth in claim 1 and including the steps of forming said tubular member to have opposed ends, and forming one of said ends of said tubular member to be engageable with said snap disc.

3. A method of making an electrical switch construction as set forth in claim 2 and including the steps of forming said other switching unit to comprise a movable switch blade carried by said housing means, and forming the other of said ends of said tubular member to be engageable with said switch blade.

4. A method of making an electrical switch construction as set forth in claim 3 and including the step of forming said tubular member of electrical insulating material.

5. A method of making an electrical switch construction as set forth in claim 3 and including the steps of forming said switch blade to have an opening passing therethrough, and extending a portion of said plunger through said opening.

6. A method of making an electrical switch construction as set forth in claim 5 and including the steps of forming said one switching unit to have a snap-acting means, and forming said portion of said plunger to have an end means engageable with said snap-acting means for causing snap acting thereof when said plunger is moved to another axial position thereof by said actuator means sensing the other of said conditions.

7. A method of making an electrical switch construction as set forth in claim 1 and including the steps of forming said housing means to have a wall provided with opposed sides and an opening therethrough, projecting a portion of said plunger through said opening of said wall, projecting a portion of said tubular member through said opening of said wall, and forming said snap disc to be engageable with one of said opposed sides of said wall when snapped overcenter to limit movement of said snap disc in one snapped direction of movement thereof.

8. A method of making an electrical switch construction as set forth in claim 7 and including the step of forming said other switching unit to comprise a movable switch blade carried by said housing means and having a normal bias tending to place said movable switch blade against the other of said opposed sides of said wall.

9. A method of making an electrical switch construction as set forth in claim 8 and including the steps of forming said tubular member to have opposed ends, forming one of said ends of said tubular member to be engageable with said snap disc and the other of said ends of said tubular member to be engageable with said switch blade, and forming said tubular member to be adapted to hold said switch blade away from said other of said opposed sides of said wall when said snap disc has been moved overcenter.

10. A method of making an electrical switch construction as set forth in claim 9 and including the steps of forming said other switching unit to have a fixed contact means, and forming said movable switch blade to be out of contact with said fixed contact means when said movable switch blade is against said other of said opposed sides of said wall and to be held against said fixed contact by said tubular member when said snap disc has been moved overcenter.

11. A method of making an electrical switch construction as set forth in claim 10 and including the steps of forming said switch blade to have an opening passing therethrough, and extending a portion of said plunger through said opening of said switch blade.

12. A method of making an electrical switch construction as set forth in claim 1 and including the steps of forming said spring means to comprise a coiled compression spring having opposed ends, and telescopically disposing said spring on said plunger, forming said plunger to have an annular shoulder, and engaging one of said ends of said spring against said shoulder.

13. A method of making an electrical switch construction as set forth in claim 12 and including the step of forming the other of said ends of said spring to engage said snap disc.

14. A method of making an electrical switch construction as set forth in claim 12 and including the steps of forming said actuator means to comprise a force spreader provided with an opening therethrough, disposing a portion of said plunger through said opening of said force spreader, and engaging the other of said ends of said spring against said force spreader to hold said force spreader in engagement with said snap disc.

* * * * *